US008517384B2

(12) United States Patent
Carbonaro

(10) Patent No.: US 8,517,384 B2
(45) Date of Patent: Aug. 27, 2013

(54) ROULETTE GAME

(76) Inventor: Anthony M. Carbonaro, Middle Village, NY (US)

( * ) Notice: Subject to any disclaimer, the term of this patent is extended or adjusted under 35 U.S.C. 154(b) by 695 days.

(21) Appl. No.: 12/285,125

(22) Filed: Sep. 29, 2008

(65) Prior Publication Data

US 2009/0042635 A1 Feb. 12, 2009

Related U.S. Application Data

(63) Continuation of application No. 11/785,594, filed on Apr. 18, 2007, now Pat. No. 7,431,298.

(51) Int. Cl.
*A63F 5/02* (2006.01)

(52) U.S. Cl.
USPC ..... 273/274; 273/142 E; 463/17

(58) Field of Classification Search
USPC ..... 273/274, 142 E–142 H, 142 HA, 273/142 J, 142 JA, 142 JB, 142 JC, 142 JD; 463/17
See application file for complete search history.

(56) References Cited

U.S. PATENT DOCUMENTS

| | | | | |
|---|---|---|---|---|
| 1,556,678 | A | 10/1925 | Diegel | |
| 1,689,326 | A | 10/1928 | Cragie | |
| 1,811,960 | A | 6/1931 | Orr | |
| 3,502,336 | A * | 3/1970 | Krueger Jr. | 273/305 |
| 3,819,186 | A | 6/1974 | Hinterstocker | |
| D275,116 | S | 8/1984 | Mickens | |
| 5,934,999 | A * | 8/1999 | Valdez | 463/17 |
| 6,059,659 | A * | 5/2000 | Busch et al. | 463/17 |
| 6,164,647 | A | 12/2000 | Chee | |
| 6,176,489 | B1 | 1/2001 | Astaneha | |
| 6,217,022 | B1 | 4/2001 | Astaneha | |
| 6,467,770 | B1 | 10/2002 | Matosevic | |
| 6,688,598 | B1 * | 2/2004 | Hsi | 273/292 |
| 7,478,812 | B2 * | 1/2009 | Sokolov | 273/142 R |
| 2002/0169017 | A1 | 11/2002 | Visoenik | |
| 2004/0116179 | A1 | 6/2004 | Nicely et al. | |
| 2005/0080638 | A1 | 4/2005 | Maseruka | |
| 2005/0192079 | A1 | 9/2005 | Lowery | |
| 2005/0285336 | A1 | 12/2005 | Ilievski | |

OTHER PUBLICATIONS

Scarne, John, Scarne's New Complete Guide to Gambling, Simon and Shuster, 1974, pp. 393-429.

* cited by examiner

*Primary Examiner* — Benjamin Layno
(74) *Attorney, Agent, or Firm* — Richard C. Litman

(57) ABSTRACT

The roulette game is based upon a wheel having multiple series of consecutive numbers thereon. Each number is distinguished by a color, with a different quantity of colors repeating to provide a unique color and number combination for each position on the wheel. The colors may be selected to represent the colors of a national flag, e.g., red, white, and blue for the U.S., red, white, and green for Mexico, etc. House profit may be provided by payment of lower than actual odds, by the retention of a percentage of winning wagers, or by designating one or more wheel positions as winning positions for the house. This system may incorporate a progressive wagering system wherein retention of the house profit is waived for players who choose to place progressive wagers on consecutive plays of the wheel.

15 Claims, 10 Drawing Sheets

ROULETTE GAME

REFERENCE TO RELATED PATENT APPLICATION

This application is a continuation in part of U.S. patent application Ser. No. 11/785,594, filed on Apr. 18, 2007 now U.S. Pat. No. 7,431,298.

BACKGROUND OF THE INVENTION

1. Field of the Invention

The present invention relates generally to wagering games, and more particularly to a roulette game having numbers in repeating or random sequences with identical numbers having different colors.

2. Description of the Related Art

The general concept of the roulette wheel having a large number of wagering positions has been known for some time. Game rules generally permit players to place wagers on one or more of the positions on the wheel, with various wagering combinations being permitted, e.g., single numbers, odd or even numbers, numerical series, colors, etc. In most roulette games, one or more "zero" positions are provided, which provide the casino with a winning "edge." In other situations, the house provides lower than actual odds for payment of winning wagers, in order to provide a house profit. An example of a conventional roulette game (but involving electronic or computerized simulation of play) is found on a web page published by SBG Global.com, at least as of Feb. 5, 2007, which describes conventional roulette play and wagers. House profit is provided by payment of lower odds, rather than by retaining a percentage of player winnings.

In other games, players are permitted to place wagers on any of the positions on the wheel, with the house payment for winning wagers being lower than actual odds in order to provide a profit for the gambling establishment. However, none is seen to describe the instant invention as claimed. Thus, a roulette game solving the aforementioned problems is desired.

SUMMARY OF THE INVENTION

The roulette game has a roulette wheel incorporating plural sequentially or randomly repeating series of numbers in combination with a plurality of sequentially or randomly repeating color sets. The combination of numbers and colors provides a unique number and color combination at each position on the wheel. The colors may be selected to represent the colors of a national flag, e.g., red, white and blue for the U.S. flag, etc. Additional positions may be provided on the wheel by the use of multiple colors at those additional positions or by other dedicated positions. The wheel may lie in a horizontal plane with a vertical axle, or may be installed upon a horizontal axle to lie in a vertical plane, or at some intermediate angle between the horizontal and vertical.

The roulette game lends itself well to use as a gambling or casino type game, including various methods of play and payout provisions. Wagers may be placed upon any single number, a range of numbers, odd or even numbers, and/or one or more of the colors on the wheel, as desired. Preferably, payment of winning wagers is made according to the actual odds determined by the number of positions on the wheel, e.g., 29:1 for a wager on a single position in a wheel having thirty positions. House profit may be provided by retention of a percentage of the payout, rather than by adjusting the payout odds. Alternatively, additional positions may be provided on the wheel for the house, and/or the payout odds may be adjusted to allow a house profit margin.

The aspect of house retention of a percentage of the winning wager facilitates another aspect of play, in which players may place progressive wagers. The method of play preferably waives the retention of a percentage of winning wagers to players who continue to play a given number or combination through multiple consecutive turns, i.e., place progressive wagers. This encourages players to place such progressive wagers by providing a higher payout to a winning player who places a progressive wager for the next round of play. The provision for retention of a percentage of winning wagers for the house profit greatly facilitates such a system of rewarding players who place progressive wagers. The waiver of retention of a percentage of a winning wager, is much easier than determining some other financial encouragement for a progressive wagering player when the house profit is determined by adjusting the payout odds.

Alternatively, additional positions may be placed upon the wheel and table to expand the number of possible winning positions. These additional positions may be in the form of an emblem or logo representative of the game, multiple colors representing the colors of a national flag or the like and matching the multiple colors disposed about the wheel, or other patterns or configurations as desired. The payout would remain the same as for a wheel without those additional positions, in order to provide a house margin.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to different embodiments of a roulette game in which, in at least one embodiment, payouts to winning players are adjusted advantageously for winning players who continue to play over more than one round of play, i.e., place progressive wagers. The wheel and corresponding wagering layout (table, felt, etc.) include novel combinations of numbers and colors for the wagering positions thereon.

Figure 1:
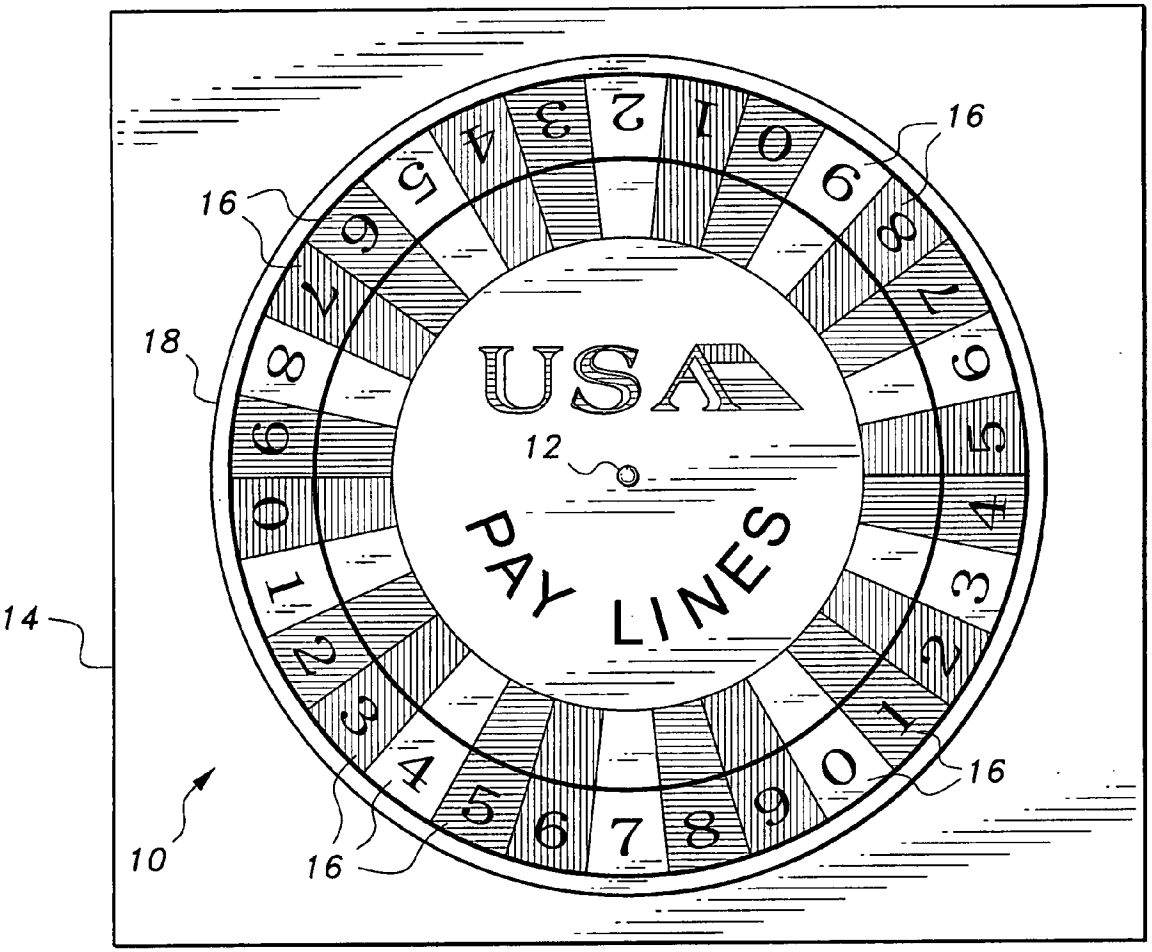
FIG. 1 is a top plan view of an exemplary horizontally oriented roulette wheel for a roulette game according to the present invention, showing its features.

FIG. 1 of the drawings provides a top plan view of a horizontally disposed roulette wheel 10 according to the present invention. The wheel 10 rotates about an axle 12 oriented vertically, at least generally. The axle 12 is preferably aligned with the vertical as closely as is practicable and extends upwardly from a substantially horizontal table or supporting surface 14. The wheel 10 correspondingly rotates in a substantially horizontal plane. The evenly distributed wagering positions 16 disposed about the wheel periphery 18 are preferably divided conventionally in order for a conventional roulette ball to drop into one of the positions to determine the winning position at each turn.

Specific wagering positions 16 are described in accordance with the unique number and color combination provided for each position, e.g., white zero at about the five o'clock position as shown in FIG. 1, red seven at about the ten o'clock position, etc. The wagering positions 16 of the exemplary wheel 10 of FIG. 1 comprise three sets of regularly repeating number sequences from zero to nine inclusive, i.e., each set contains ten numbers for a total of thirty positions disposed about the wheel periphery.

The numbered positions are further distinguished by color, with ten sets of regularly repeating colors of three colors each being provided upon the wagering positions 16. Preferably, the quantity of each set of numbers and the quantity of each set of colors, e.g., ten numbers and three colors in the case of the wheel 10 of FIG. 1, have no mutually common factor. In the case of the wheel 10 of FIG. 1, this requires a total of thirty positions 16 about the wheel 10 before a repeat of a specific number and color can occur. Thus, each of the thirty wagering positions 16 of the wheel 10 comprises a unique number and color combination, with like numbers having different colors and like colors being numbered differently from one another.

Figure 2:
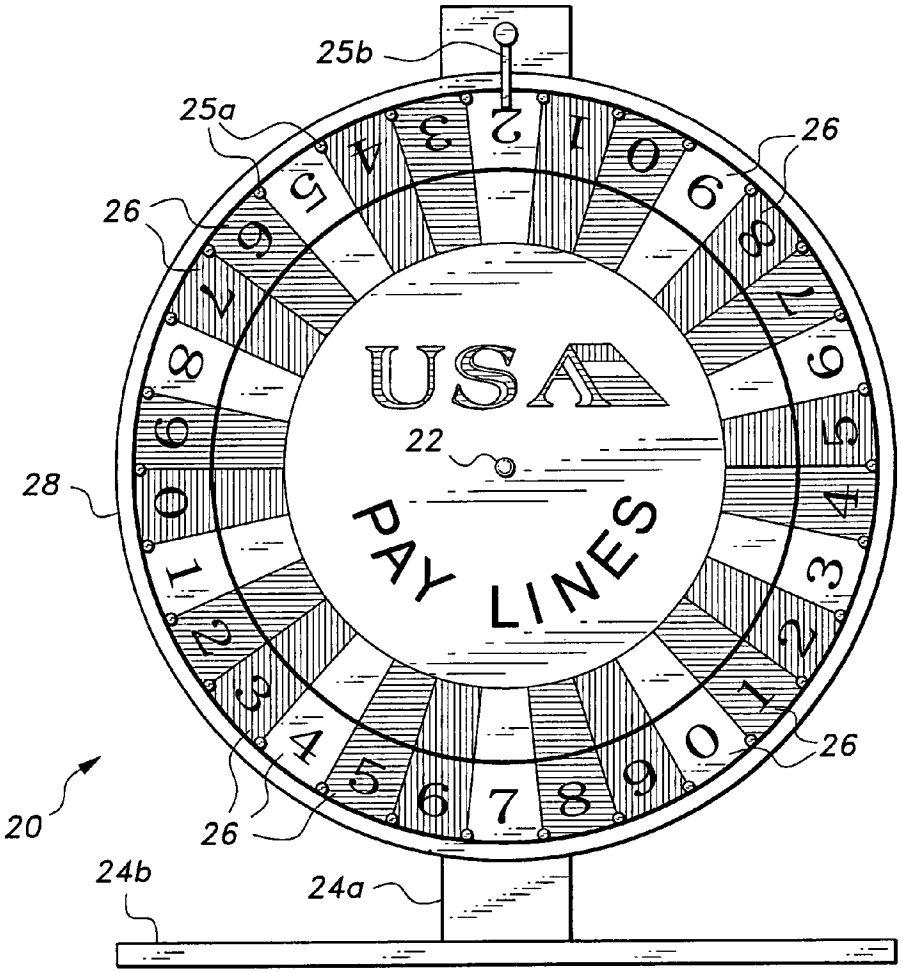
FIG. 2 is a front elevation view of a vertically oriented wheel for a roulette game according to the present invention, illustrating various details thereof.

FIG. 2 of the drawings illustrates an alternative embodiment of a wheel 20 for use with the roulette game, with the wheel 20 having a substantially horizontally disposed axle 22 and rotating in a substantially vertical plane. The axle 22 extends from a substantially vertically disposed column 24*a*, which extends upwardly from a base 24*b*. Rather than utilizing a ball which drops into one of the wagering positions of a horizontally oriented wheel, the vertical wheel 20 of FIG. 2 may include a series of pins 25*a* disposed about the periphery 28 thereof and extending normal to the plane of the wheel 20, with a resilient finger 25*b* extending from the top of the column 24*a* to engage the pins 25*a* as the wheel 20 rotates.

The wheel 20 of FIG. 2 has essentially the same configuration as the wheel 10 of FIG. 1, having a plurality of evenly distributed wagering positions 26 disposed about the periphery 28 thereof. The wagering positions 26 of the wheel 20 of FIG. 2 will be seen to correspond exactly to the wagering positions 16 of the wheel 10 of FIG. 1, i.e., having three sets of regularly repeating number sequences from zero to nine inclusive, with each set containing ten numbers for a total of thirty positions disposed about the wheel periphery 28. The numbered positions are further distinguished by color, with ten sets of regularly repeating colors of three colors each being provided upon the wagering positions 26. Specific wagering positions 26 of the wheel 20 of FIG. 2 are described in the same manner as used for the positions 16 of the wheel 10 of FIG. 1, e.g., blue two at about the eight o'clock position as shown in FIG. 2, white six at about the two o'clock position, etc.

Figure 3:
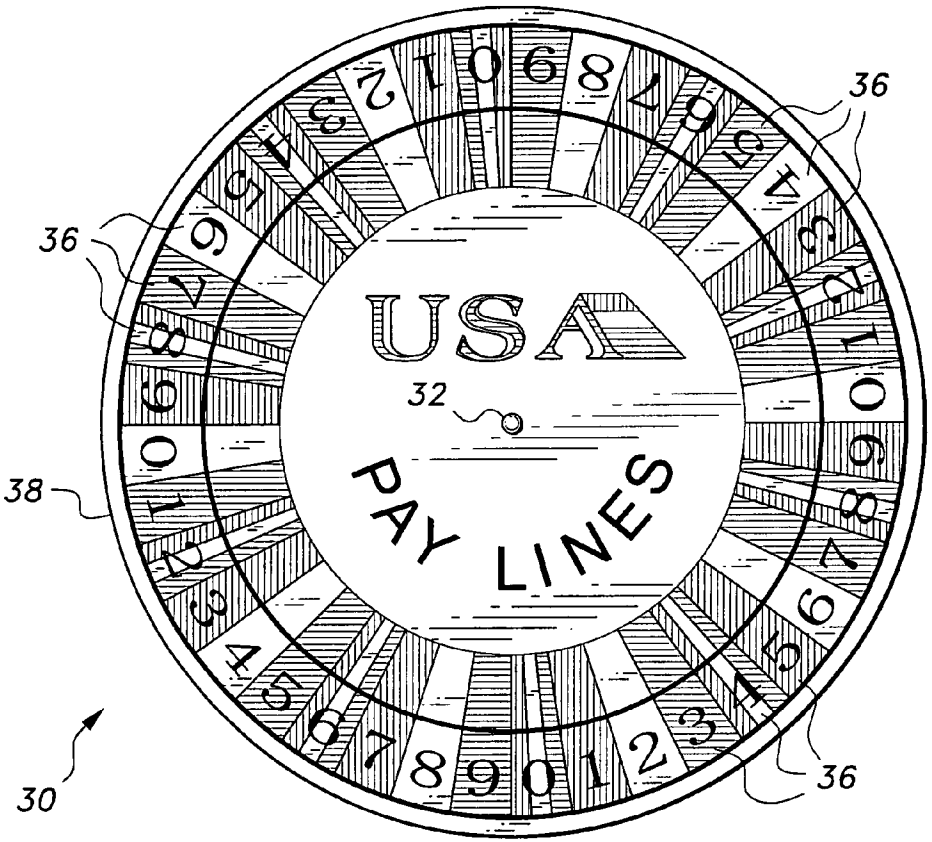
FIG. 3 is a top plan view of an alternative embodiment of a wheel for a roulette game according to the present invention, illustrating details thereof.

FIG. 3 provides a view of an exemplary alternative embodiment roulette wheel 30 of the roulette game. The wheel 30 is disposed upon an axle 32. The axle 32 may be oriented either vertically or horizontally, with the wheel 30 being normal to the axle, as in the examples of FIGS. 1 and 2. The wheel 30 of FIG. 3 includes a total of forty evenly distributed wagering positions 36 disposed about its periphery 38, rather than only thirty such positions, as in the examples of FIGS. 1 and 2. The wagering positions 36 of the wheel 30 of FIG. 3 comprise four sets of regularly repeating number sequences from zero to nine inclusive, with each set containing ten numbers for a total of forty positions disposed about the wheel periphery 38. The numbered positions are further distinguished by color, with ten sets of regularly repeating sets of three colors and a fourth multiple color position each being provided upon the wagering positions 36. Specific wagering positions 36 of the wheel 30 of FIG. 3 are described in the same manner as used for the positions 16 of the wheel 10 of FIG. 1 and positions 26 of the wheel 20 of FIG. 2, e.g., blue five at about the seven o'clock position, as shown in FIG. 3, multiple color two at about the two o'clock position, etc.

It will be noted that there are two factors for the quantity of numbers used in each number set and the quantity of different colors (including the multiple color positions) in each color set in the wheel 30, i.e., forty, the total number of positions, and twenty. Thus, it will be seen that each wagering position 36 is repeated twice on the wheel 30 of FIG. 3. This enables players to double their chances with a wager upon a single number and color combination, with the payout odds being adjusted accordingly. Alternatively, the quantity of colors could be changed to avoid multiple factors relative to the numbers of the wheel, and/or the quantity of numbers in each set could be adjusted, as desired.

Figure 4:
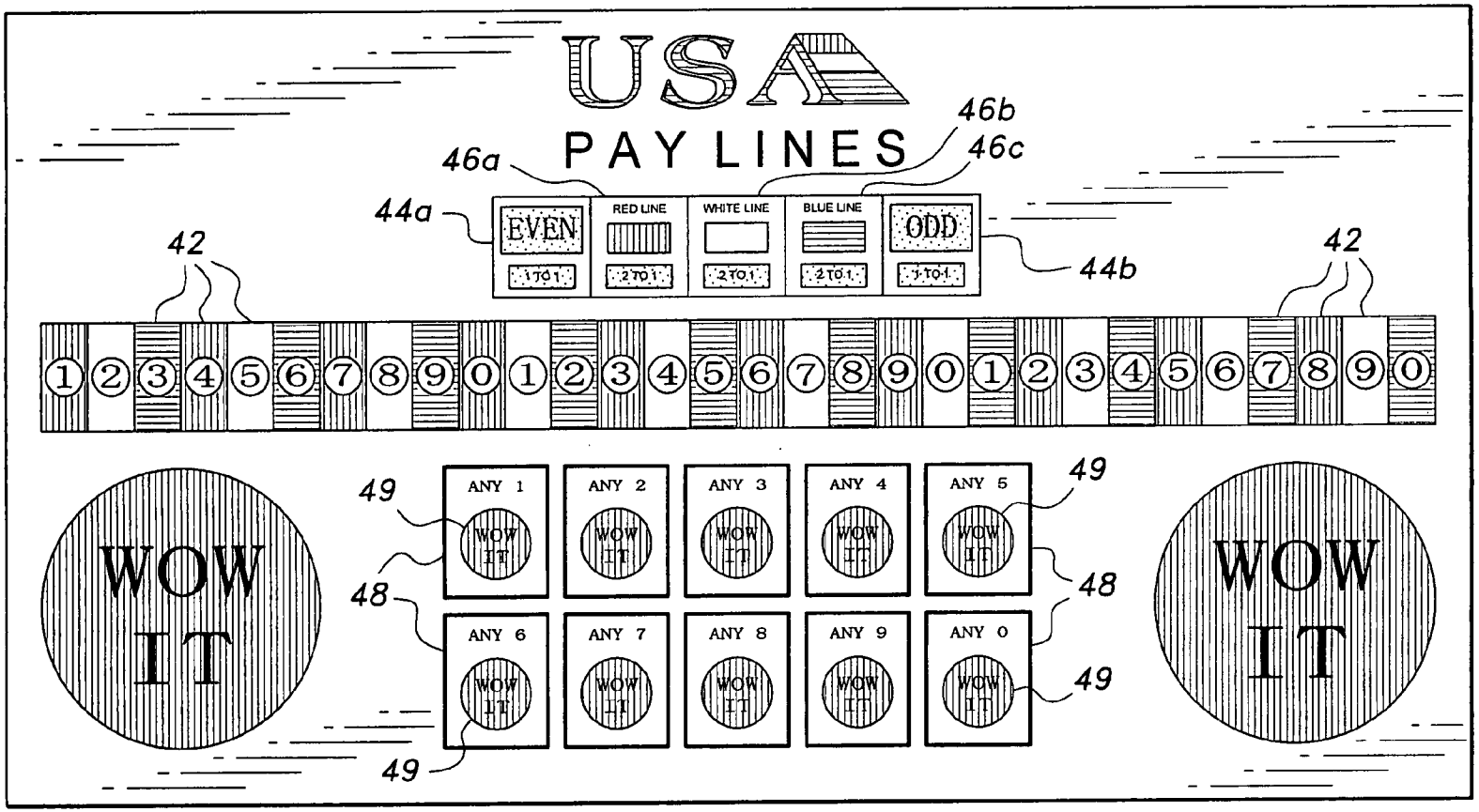
FIG. 4 is a top plan view of an exemplary wagering table for a roulette game according to the present invention, which may be used with the wheel of either FIG. 1 or FIG. 2.

FIG. 4 provides an illustration of a wagering layout 40, i.e., table surface layout or "felt," which may be used with either of the three-color wheels 10 or 20 respectively of FIGS. 1 and 2. The wagering layout 40 may comprise a single common surface for use by all players in placing wagers in the roulette game, or may, alternatively, comprise a separate, individual surface for each player in the game. In either case, the wagering layout 40 includes a plurality of wagering positions 42 corresponding to the wagering positions 16 (or 26) of the wheel 10 (or 20).

The wagering positions 42 comprise three sets of regularly repeating number sequences from zero to nine inclusive, i.e., each set contains ten numbers for a total of thirty positions disposed upon the layout 40. The numbered positions are further distinguished by color, with ten sets of regularly repeating colors of three colors each being provided upon the wagering positions 42. Thus, the series of wagering positions 42 of the wagering layout 40 have a direct, one-to-one correspondence with the wagering positions 16 of the wheel 10, or positions 26 of the wheel 20, with each of the wagering positions 42 comprising a unique number and color combination. It will be seen that forty such wagering positions could be provided, if so desired, to correspond with the forty positions of the wheel 30 of FIG. 3.

The above-described wagering positions permit players to place wagers upon any given unique number and color position combination. However, the roulette game also provides for wagers similar to those of other roulette games, e.g., wagers upon all of the even numbers of the wheel or all of the odd numbers of the wheel. "Even" and "Odd" positions, respectively 44*a* and 44*b*, are provided on the wagering layout for such even or odd wagers. In addition, players may place wagers upon all of the positions having a common color, e.g., red, white, or blue. Provision for such color position wagers is accomplished by a series of corresponding color wager positions, e.g., a "red line" position 46*a*, a "white line" position 46*b*, and a "blue line" position 46*c*, on the wagering layout 40. It will be understood that the number of color positions, and the payout odds, may be adjusted to correspond with the addition of more colors to the wagering positions of the wheel, as in the case of the multiple color positions added to the wheel 30 of FIG. 3.

Players may also place wagers upon individual numbers, regardless of color, if they so choose. This is provided for by the series of ten numbered playing positions 48 of the wagering layout 40. A wager placed upon any one of the numbered playing positions 48 is a wager upon all of the corresponding numbers of the wheel, e.g., three playing positions in the case of the wheels 10 and 20 respectively of FIGS. 1 and 2, with their thirty positions each. As there are nine possible losing numbers for each potential winning number, the payout odds in the present game are nine to one, assuming that the house does not adjust the payout odds to retain a profit margin. Preferably, the house retains a percentage of any winning wager as a house profit, as discussed further below.

The roulette game permits players to place progressive wagers, i.e., to place a subsequent wager upon the same or a different wagering position after winning on the previous turn. As an example of the above, a player playing the number seven (regardless of color) by placing a wager on the "any 7" position 48 of the wagering layout 40, would win his or her wager if any of the three positions containing the number seven were to turn up on a play of the wheel. That winning player could then make a progressive wager on the next play, wagering that the same number (or alternatively, a different number, if the player wishes to change his or her wager to a different number) will win. This progressive wagering provision is indicated by the "Wow it" designations 49 disposed upon each of the number playing positions 48 on the layout 40. Alternatively, some other designation may be used to indicate provision for progressive wagers, if desired.

It will be noted that the colors provided on the wheels 10, 20, and 30, respectively, of FIGS. 1, 2, and 3, and the table layout 40 of FIG. 4, are red, white, and blue. These three colors have been selected intentionally to represent the colors of the American flag. It will be seen that any colors may be selected as desired to represent the colors of the flag of a particular nation, or perhaps a school or college, a sports team, a business or other organization, etc. The colors selected for the table layout 40 of FIG. 4, also correspond with the selected red, white, and blue colors of the roulette wheels 10 and 20 of FIGS. 1 and 2.

Figure 5:
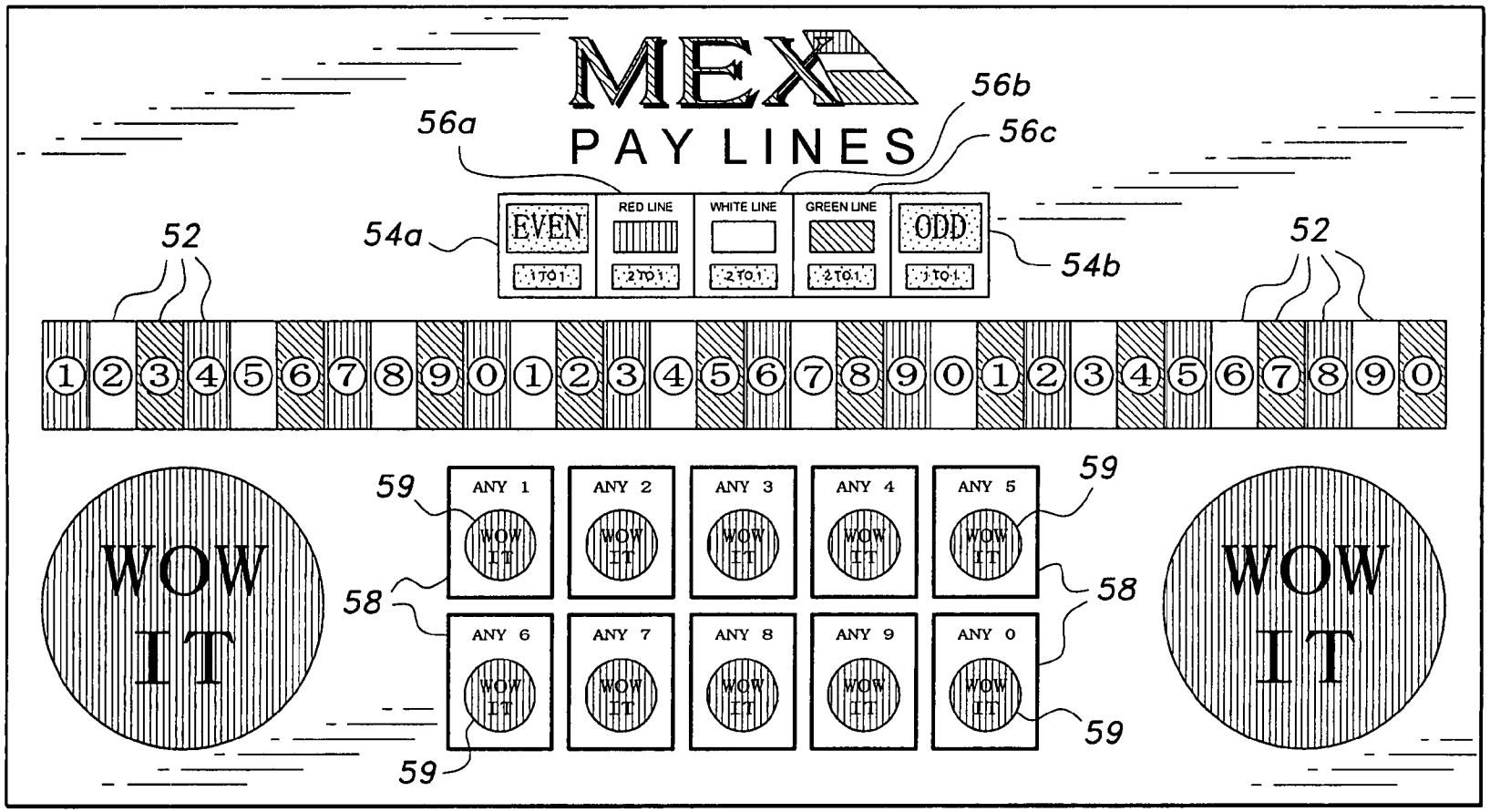
FIG. 5 is a top plan view of an exemplary wagering table for a roulette game according to the present invention for use with a wheel that incorporates the colors of the flag of Mexico.

FIG. 5 provides an illustration of an alternative table layout 50 in which the selected colors are red, white, and green, i.e., the national colors of Mexico. It will be seen that the various wagering positions, i.e., the series of individual wagering positions 52, the even and odd number wagering positions 54*a* and 54*b*, the color wagering positions 56*a*, 56*b*, and 56*c*, the number wagering positions 58, and the progressive or "wow it" wagering positions 59, all correspond to the equivalent positions 42 through 49 of the wagering layout 40 of FIG. 4, with the exception being the substitution of the color green on the layout 50 of FIG. 5 for the color blue of the layout 40 of FIG. 4. Thus, every third numbered position 52 of the layout 50, i.e., three, six, nine, twelve, etc., is colored green, rather than blue as in the layout 40, and rather than having a blue color wagering position, as in the position 46*c* of the layout 40, the layout 50 includes a green color wagering position 56*c*.

Accordingly, the table layout 50 of FIG. 5 would find great favor in a casino in Mexico, or a Mexican theme casino, hall, or gaming room or the like. The roulette wheel used with the red, white, and green table layout 50 is configured substantially identically to the wheels 10 and 20 of FIGS. 1 and 2, but uses green for the color in lieu of the blue portions of those wheels 10 and 20 in order to match precisely the colors used on the Mexican themed table layout 50 of FIG. 5. It will also be seen that either of the table layouts 40 or 50 may be expanded to include more numbers and colors (or multiple color combinations), in keeping with the roulette wheel 30 of FIG. 3 and its multiple color positions.

Figure 6:
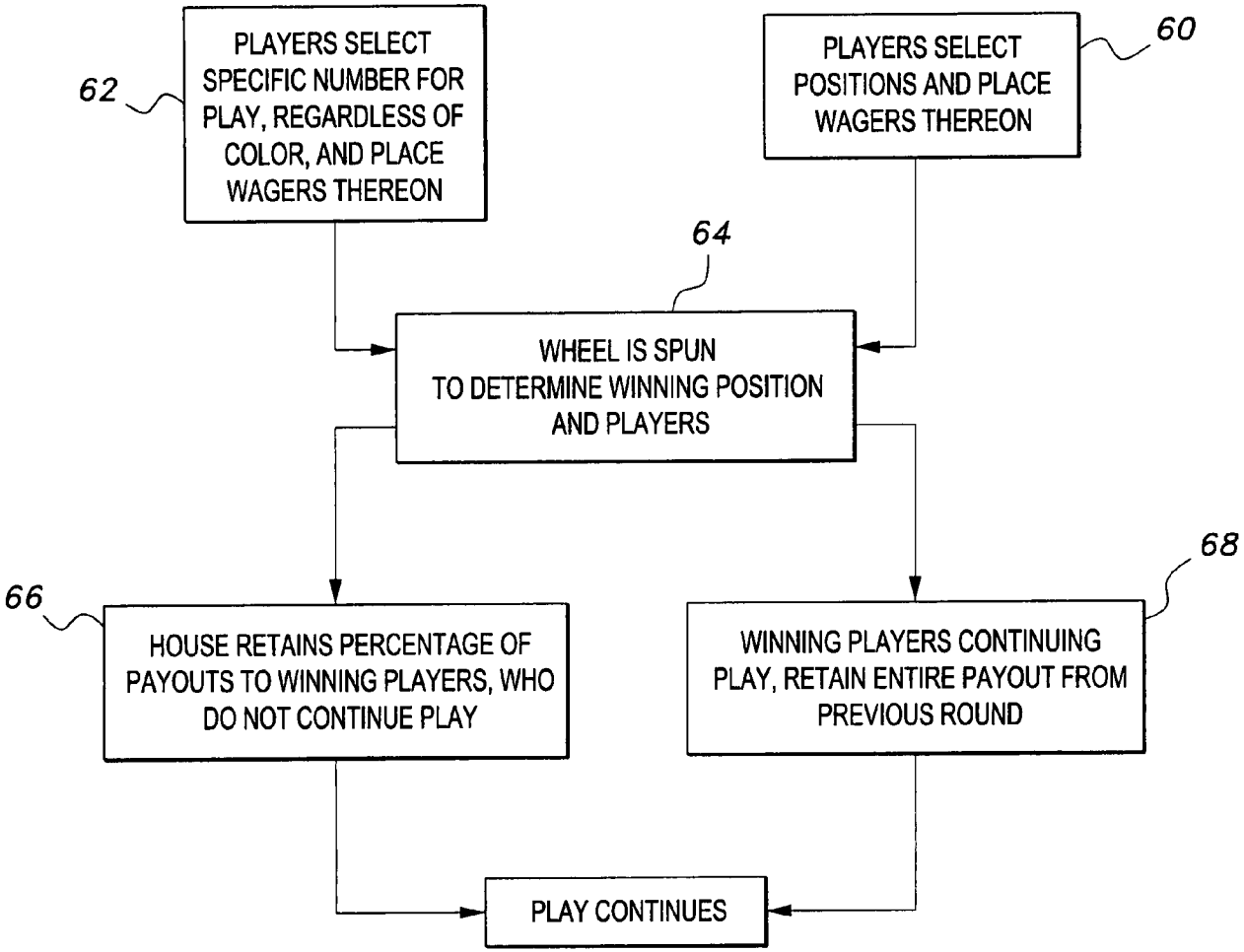
FIG. 6 is a flowchart illustrating the basic steps in the method of play of a roulette game according to the present invention.

FIG. 6 provides a flow chart illustrating the basic steps in the method of play of the present roulette game. Initially, participating players each place at least one wager on a selected wagering position(s) on the table layout, with the selected wagering position(s) corresponding to the wagering position(s) of the roulette wheel of the game, generally as indicated by the first step 60 of FIG. 6. These wagers may be placed upon a specific number or series of numbers (e.g., odd or even), a specific color or colors, etc., as desired and as permitted by the rules of the gaming house and/or controlling authority (gaming commission, etc.).

Many players may elect to play a certain specific number or numbers, regardless of colors or color combinations. This is provided for by the number playing positions 49 and 59, respectively of the table layouts 40 and 50 of FIGS. 4 and 5. A wager(s) placed upon these number positions is not limited by color. Thus, a wager placed upon a single number actually has three chances of winning on the roulette wheels 10 and 20 of FIGS. 1 and 2, as each number repeats three times in the thirty positions about the wheel. This alternative wager is represented by the second step 62 of FIG. 6. At this point, the wheel is spun to randomly determine the winning position, as indicated by the third step 64 of FIG. 5. A marker (e.g., representation of the Statue of Liberty, for an American themed game, etc.) may be placed upon the winning position of the table layout, to indicate this winning position.

At this point, three different general possibilities exist. First, all players whose wagers were different than the winning position, lose their wagers. (This possibility is not indicated in the flow chart of FIG. 5, as it is conventional.) However, winning players are provided with two options at this point. Winning players who do not wish to continue play may leave the game at this point. However, the casino retains a percentage of the player's winning wager as the house profit, rather than lowering the payout odds to the player.

As an example of the above, a player placing a wager upon one of the three colors of the wheel 10 or 20 of FIG. 1 or 2, has a one in three chance of winning. Thus, the odds against the player are two to one, i.e., two losing colors and one winning color. Accordingly, the house payout is two to one, or precisely the odds provided by chance in the game. In order to make a profit, the house may retain some percentage of the winning wager (e.g., five percent, or as provided for by the rules), generally as indicated by the fourth step 66 of the flow chart of FIG. 6. This system of payment of the actual odds and retention of a percentage of winning wagers simplifies the wagering system for progressive wagers, as explained below.

The roulette game rules provide encouragement for winning players who wish to continue play, i.e., progressive wagering over more than one turn of play. In accordance with the rules of play, winning players who place a subsequent wager for the next turn or round of play are rewarded by the casino waiving the retention of the house profit percentage, generally as indicated by the fifth step 68 of FIG. 6. However, the payout for all winning wagers remains exactly the same as the odds of winning, e.g., nine to one for a player betting on one of the ten numbers, with the house profit coming only from the retention of a percentage of winning wagers by non-continuing players. Successful progressively wagering players may be acknowledged by placement of a marker (e.g., "superfecta man," etc.) at that player's position for a series of consecutive winning wagers, if so desired.

The above rule may be adjusted by restricting progressive wagers only to numerical designations on the wheel, i.e., to the placement of wagers on one or more of the number playing positions 48 (or 58) of the wagering or table layout 40 of FIG. 4 (or 50 of FIG. 5). In accordance with this rule, a player placing an even or odd number bet, or a color bet, could continue play after winning, but would have his winning wager treated in the manner of a terminating player by the house retaining a percentage of the winning wager. Alternatively, the rules could allow all winning players who continue in the next turn of play to be considered as progressive wagering players regardless of the specific type of wager made, i.e., the house waiving retention of a profit percentage of any and all winning wagers for continuing players, if so desired and if in accordance with the rules of play.

The rules may be adjusted further if in accordance with any limitations imposed by the gaming commission and/or other governing body. For example, the rules may permit the casino or house to retain a greater percentage of winning wagers in the case of consecutive winning turns of play, i.e., progressive wagers. As an example, the house may retain ten percent of winning consecutive or progressive wagers, rather than the five percent (or other percentage) of wagers retained after a single turn or round of play. This higher retention of winning progressive wagers is likely acceptable to the winning player, as he or she will have won at least two consecutive rounds or turns of play by this point, with corresponding winnings.

Figure 7:
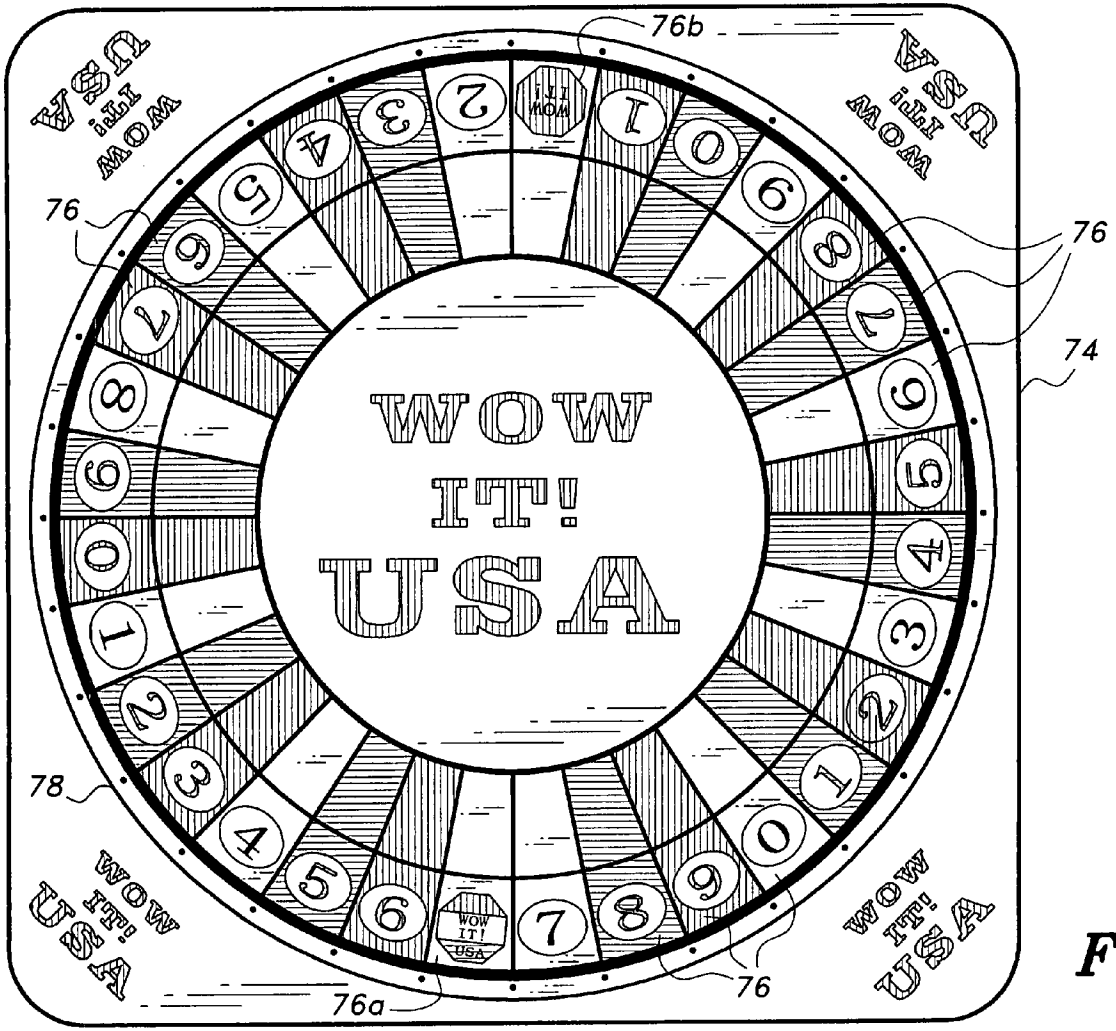
FIG. 7 is a top plan view of another alternative embodiment of a wheel for a roulette game according to the present invention, illustrating details thereof.

FIGS. 7 through 10 of the drawings illustrate additional embodiments of a roulette game, with FIG. 7 illustrating an exemplary roulette wheel 70. The roulette wheel 70 is similar to that of FIG. 1, having a generally vertical axle (not shown in FIG. 7, but substantially as provided in FIG. 1) extending upwardly from a table or supporting surface 74. The wheel 70 includes a series of evenly spaced or distributed first indicia wagering positions 76 about its periphery 78, e.g., three groups of ten positions 76 in each group; more or fewer such groups, or groups having different numbers of positions, may be provided, as in the case of the wheel 30 of FIG. 3 with its four groups of ten positions each. The positions are separated from one another to allow a roulette ball to drop into one of the positions during play, as is conventional with roulette wheels. Alternatively, the wheel 70 could be placed on a horizontal axis with its plane disposed vertically and provided with a pin and resilient pointer for determining the winning position during play, as in the case of the wheel 20 of FIG. 2.

The numbered first indicia positions are further distinguished by color, with ten sets of regularly repeating colors of three colors each being provided upon the wagering positions 16. These colored positions comprise a series of second indicia positions on the wheel 70, with the first and second indicia positions comprising a series of primary wagering positions disposed about the wheel 70. More or fewer colors may be provided as desired, so long as each number (first indicia position) and color (second indicia position) combination is unique, or so long as there are equal quantities of each specific first and second indicia combination, e.g., two red ones, two blue threes, etc., as shown in the exemplary wheel 30 of FIG. 3.

The wheel 70 further includes two supplemental wagering positions 76*a* and 76*b*, designated as "Wow It" positions on the wheel 70. These supplemental wagering or "Wow It" positions 76*a*, 76*b* are preferably diagonally opposite one another, although their relative positions may be distributed otherwise, if desired. The first supplemental wagering position 76*a* is marked by a combination of all three colors used to designate the colored second indicia positions 76 of the wheel 70. Alternatively the "Wow It" positions may be marked by a single solid color as in the case of the second position 76*b*, if so desired. These secondary or "Wow It" positions 76*a*, 76*b* are provided primarily to expand the total number of positions on the wheel 70 without needing another complete set of ten more primary positions. This provides the house or casino with a reasonable "edge" while providing a payout of 29:1 to winning players who have bet on a single position. Players may also place a wager on either or both "Wow It" positions 76*a* and/or 76*b*, if so desired. It will be seen that the two "Wow It" positions 76*a*, 76*b*, along with the thirty primary wagering positions 76, provide a total of thirty-two wagering positions on the wheel 70. Alternatively, a single supplemental "Wow It" wagering position may be provided, or more than two such positions may be provided, as desired.

Figure 8:
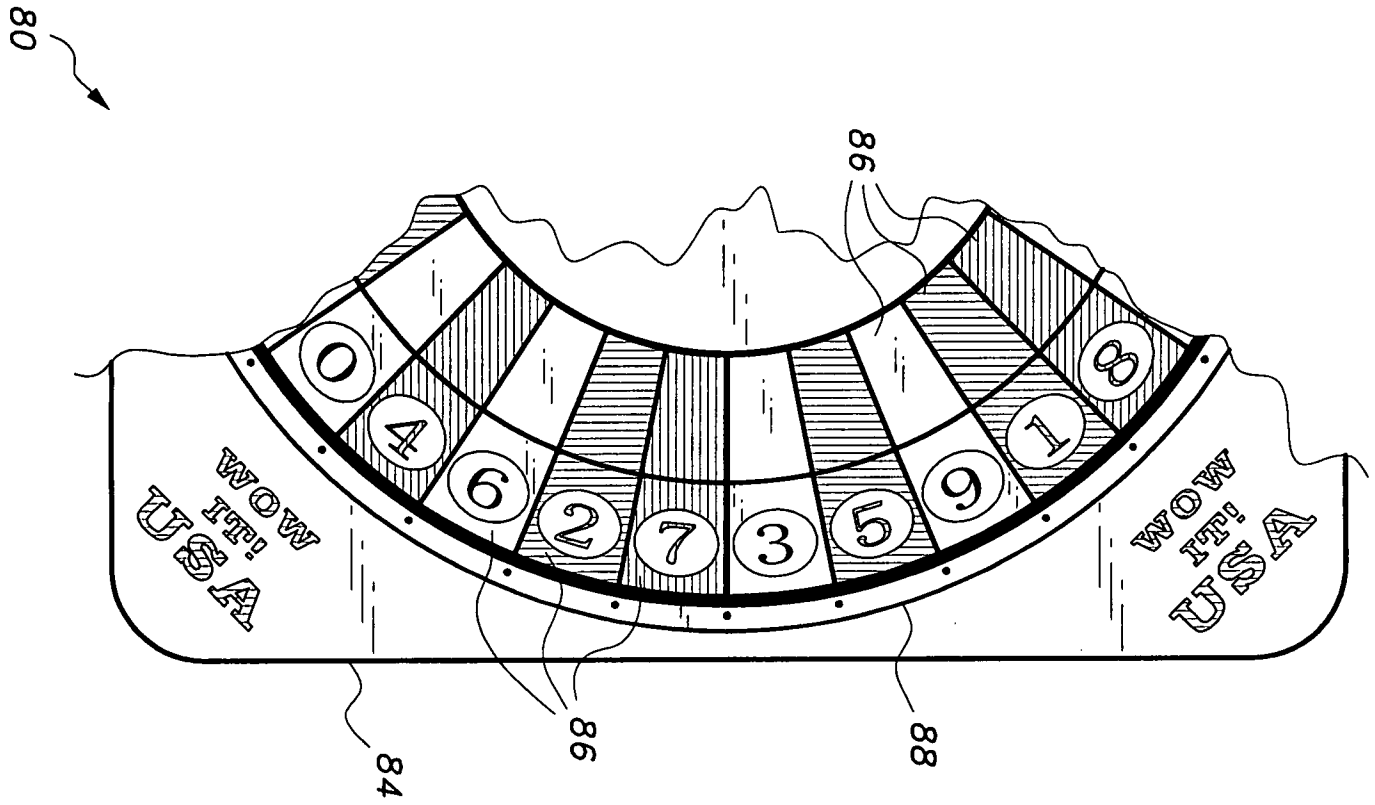
FIG. 8 is a partial top plan view of a portion of another alternative embodiment of a wheel for a roulette game according to the present invention, illustrating details thereof.

It will be noted in FIG. 7 that all of the numbered primary wagering positions 76 of the wheel 70 are in sequential order from zero to nine, with three repeats. However, sequential positioning of the numbers in each set is not a requirement of the present roulette game. FIG. 8 illustrates a broken away portion of an exemplary roulette wheel 80 and table 84 wherein the primary wagering positions 86 are randomly disposed about the periphery 88 of the wheel 80. It will be seen that FIG. 8 illustrates only a portion of the wheel 80, and the entire wheel 80 may include one or more supplemental "Wow It" positions similar to those shown as positions 76*a* and 76*b* in FIG. 7, if so desired. It will also be noted that the secondary wagering positions comprising the differently colored positions are also in random order. Alternatively, it will be seen that the sequential order of the secondary colored wagering positions shown on the wheel of FIG. 7 may be combined with the random order of the numbered first wagering positions of the wheel of FIG. 8, or the randomly numbered positions of FIG. 8 may be combined with sequentially colored positions, if so desired.

Figure 9:
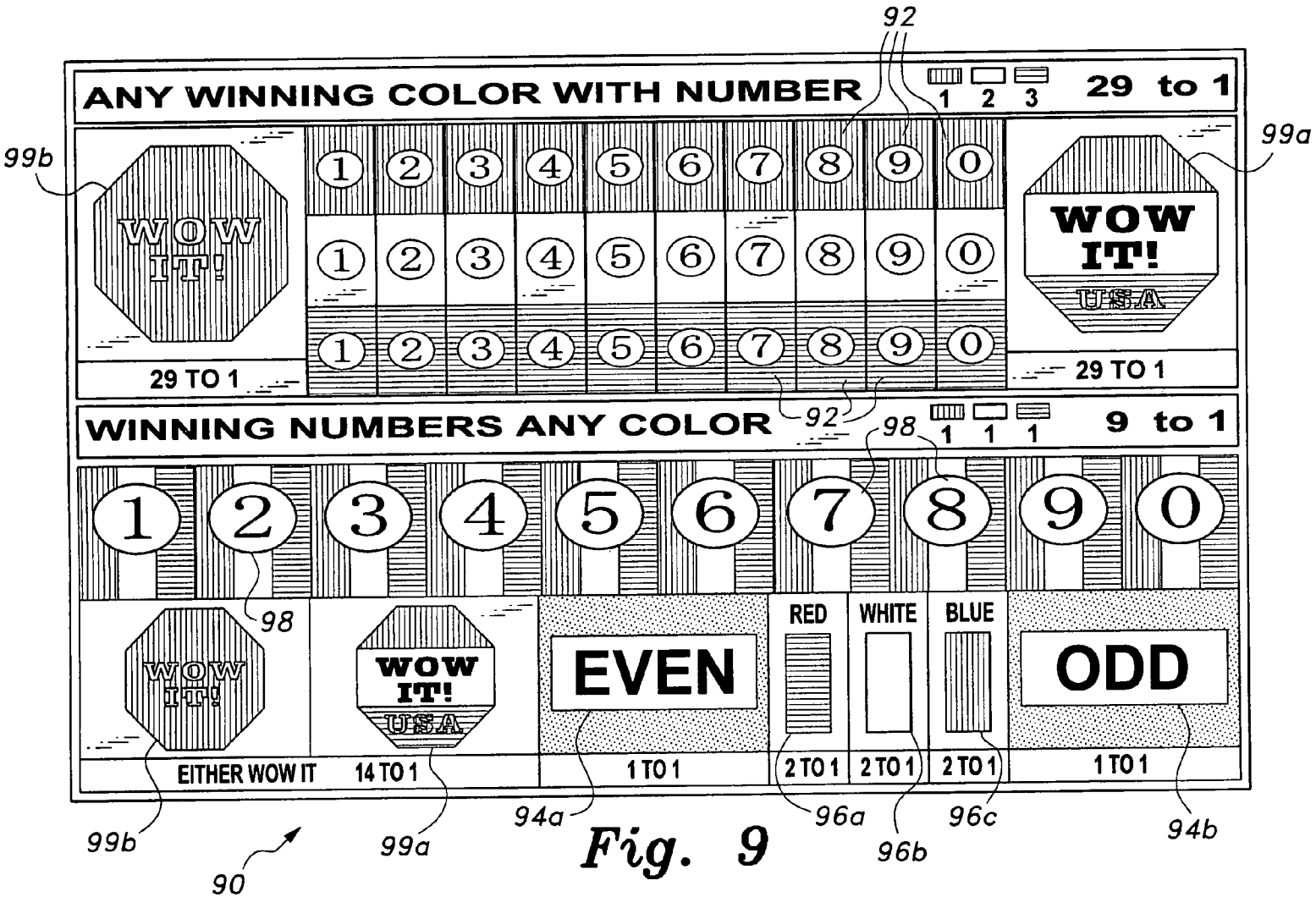
FIG. 9 is a top plan view of an alternative exemplary wagering table for a roulette game according to the present invention, which may be used with the wheel of either FIG. 7 or FIG. 8.

FIG. 9 provides an illustration of a wagering layout 90, i.e., table surface layout or "felt," which may be used with either of the three-color wheels 70 or 80, respectively, of FIGS. 7 and 8. The wagering layout 90 may comprise a single common betting surface or area for use by all players in placing wagers in the roulette game, or may, alternatively, comprise a separate, individual surface for each player in the game. In either case, the wagering layout or betting area 90 includes a plurality of wagering positions 92 corresponding to the wagering positions 76 (or 86) of the wheel 70 (or 80).

The wagering positions 92 comprise three sets of regularly repeating numbered first indicia sequences from zero to nine inclusive, i.e., each set contains ten numbers for a total of thirty positions disposed upon the layout or betting area 90. The numbered positions are further distinguished by color, with ten sets of regularly repeating colored second indicia sequences of three colors each being provided upon the wagering positions 92. Thus, the series of wagering positions comprising first and second indicia sequences 92 of the wagering layout or betting area 90 have a direct, one-to-one correspondence with the indicia sequences 76 of the wheel 70, or first and second indicia positions 86 of the wheel 80, with each of the positions 92 comprising a unique number and color combination. It will be seen that forty such wagering positions could be provided, if so desired, to correspond with the forty positions of the wheel 30 of FIG. 3.

The above-described wagering positions permit players to place wagers upon any given unique number and color position combination. However, the roulette game also provides for wagers similar to those of other roulette games, e.g., wagers upon all of the even numbers of the wheel or all of the odd numbers of the wheel. "Even" and "Odd" positions, respectively 94*a* and 94*b*, are provided on the wagering layout for such even or odd wagers. In addition, players may place wagers upon all of the positions having a common color, e.g., red, white, or blue. Provision for such color position wagers is accomplished by a series of corresponding color wager positions, e.g., a "red line" position 96*a*, a "white line" position 96*b*, and a "blue line" position 96*c*, on the wagering layout or betting surface or area 90. It will be understood that the number of color positions, and the payout odds, may be adjusted to correspond with the addition of more colors to the wagering positions of the wheel, as in the case of the multiple color positions added to the wheel 30 of FIG. 3.

Players may also place wagers upon individual numbers, regardless of color, if they so choose. This is provided for by the series of ten numbered playing positions 98 of the wagering layout or betting area 90. A wager placed upon any one of the numbered playing positions 98 is a wager upon all of the corresponding numbers of the wheel, e.g., three playing positions in the case of the wheels 10 and 20 respectively of FIGS. 1 and 2 or wheels 70 and 80 of FIGS. 7 and 8, with their thirty positions each. As there are nine possible losing numbers for each potential winning number, the payout odds in the roulette game are nine to one, assuming that the house does not adjust the payout odds to retain a profit margin. Preferably, the house provides a payout of slightly less than the actual odds or alternatively retains a percentage of any winning wager as a house profit, as discussed further below.

The betting layout or area 90 further includes at least one "Wow It" designation, and preferably a plurality of such designations or positions, e.g., first and second "Wow It" positions or indicia 99*a* and 99*b*. These positions 99*a* and 99*b* correspond to the exemplary "Wow It" supplemental indicia positions 76*a* and 76*b* of the wheel 70 of FIG. 7. While two such positions are shown on the wheel 70 and on the betting area 90, it will be understood that more or fewer such positions may be provided as desired, so long as there is a one-to-one correspondence between the number on the wheel and on the betting area. Payout odds are adjusted according to the number of "Wow It" wagers placed by a player.

Roulette play using the wheel 70 or 80 of FIG. 7 or 8 and the layout or betting area 90 of FIG. 9 is accomplished substantially in keeping with the procedure described further above and shown generally on the flowchart of FIG. 6 with respect to the wheels 10, 20, or 30, respectively, of FIG. 1, 2, or 3 and the wagering layout or betting surface 40 or 50 of FIG. 4 or FIG. 5. The wheel is spun and a winning position on the wheel is determined by conventional means, i.e., a ball spinning in a race with the ball dropping into one of the wagering positions, or a flexible detent stopping the wheel at one of the wagering positions in the case of the wheel 20 of FIG. 2.

The odds of winning are clearly established in roulette, and depend purely upon the number of evenly spaced positions about the periphery of the wheel in a fairly run game. Accordingly, the house or casino determines the odds and provides a payout to any player who has selected the winning position prior to the wheel spin. The house may pay out at lesser odds than defined by the number of positions on the wheel in order to make a profit, e.g., 29:1 for a wheel with 30 primary wagering positions and two supplemental "Wow It" positions. Alternatively, the house may provide payment in accordance with the actual odds, and retain a percentage of the payout as a profit margin.

The roulette wheels 70 and 80 of FIGS. 7 and 8 and their wagering table or betting area 90 of FIG. 9 may also provide for progressive wagering by players in the manner described further above and shown generally in the flowchart of FIG. 6, if so desired. The house or casino may encourage placement of progressive wagers by waiving retention of the house percentage for winning progressive players, or providing higher payout odds for winning progressive players where the house does not retain a percentage of winning bets. It may be desirable for the house to provide a payout in accordance with the actual odds, e.g., 30:1 for a wheel with 31 positions thereon, for progressive wagers. Such a policy would negate any house profit, of course, but the progressive wagering player will eventually lose, thereby providing the house with its profit for the gaming transaction. The house or casino may restrict progressive wagers to certain portions of the betting area 90, e.g., to only the numbered first indicia series, if so desired, or may alternatively restrict such progressive play to the colored indicia. Alternatively, the house may allow progressive wagers (and payouts as discussed above) for wagers on any of the positions of the board or area 90, if so desired.

Figure 10:
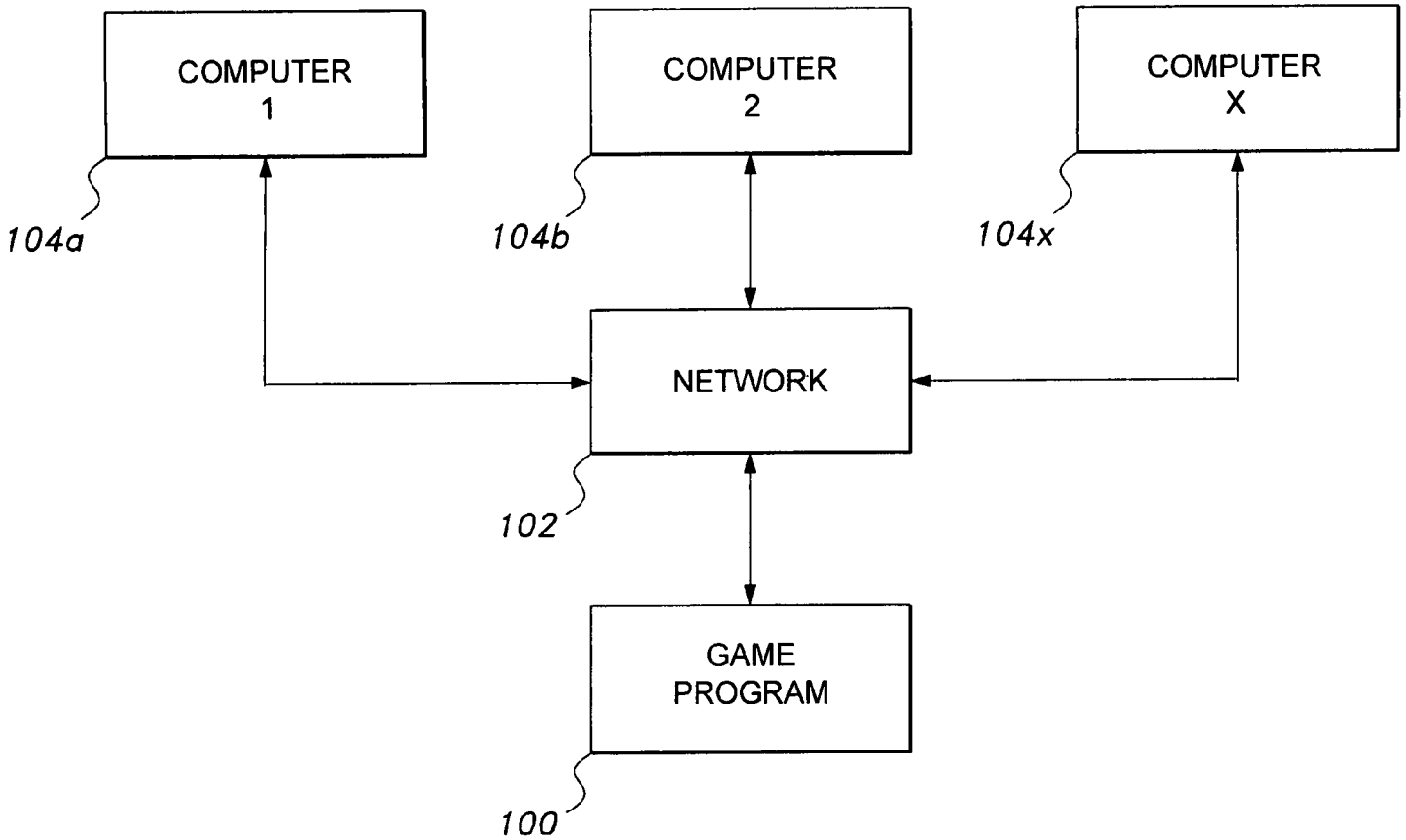
FIG. 10 is a block diagram illustrating the basic components of a network system for playing an electronic version of a roulette game according to the present invention.

The above roulette apparatus and methods of play have been described and illustrated as physical objects and actions. However, it will be seen that the roulette game, in its various embodiments, is also adaptable to computerized or electronic play through an electronically simulated roulette wheel. FIG. 10 of the drawings provides a general example of such a system for electronic play, comprising an electronic game program 100 running on a computer, electronic game machine, electronic slot machine, or the like through a computer network 102. A series of individual game stations or computers 104*a*, 104*b*, 104*x*, etc. may be used by players during simultaneous or sequential play, as desired. Such a system may be controlled through the Internet, an intranet, an extranet, or other distributed network system, e.g., as a series of gaming stations in a single casino wherein a server computer regulates the selection of game type and betting amounts, the winning position is determined by a random number algorithm executed by a processor, and the server computer determines payoff amounts in accordance with game activity and popularity. Alternatively, the electronic play system may comprise a single computer, e.g., computer 104*a*, with the program 100 installed directly therein and bypassing the network 102 to allow for personal play, if so desired.

It is to be understood that the present invention is not limited to the embodiments described above, but encompasses any and all embodiments within the scope of the following claims.

I claim:

1. A method of playing a roulette game, comprising the steps of:

providing a roulette wheel having a plurality of primary wagering positions and at least one supplemental wagering position disposed peripherally about the wheel, each of the primary wagering positions having a numerical indicium and an index indicium combination displayed thereon, the numerical indicium being selected from a set of mutually distinct numerical indicia, the index indicium being selected from a group of at least three mutually distinct background colors, each of said primary wagering positions comprising one of said numerical indicia displayed on a background of at least one of the background colors wherein the primary wagering positions are arranged in at least two sets, each of the sets consisting of ten contiguous wagering positions, each of the ten wagering positions in each set having a numerical indicium displayed on one of the at least three background colors whereby the at least three background colors appear at least three times in each set;

providing a betting layout including a first betting area having a plurality of betting positions distinguished by unique numerical indicium and index indicium combinations corresponding to the primary wagering positions displayed thereon, and a second betting area having at least one supplemental indicium displayed thereon corresponding to the at least one supplemental wagering position;

placing at least one wager upon at least one of the wagering positions of the roulette wheel, the wager being placed by each participating player on a betting area; wherein the step of placing the wager is executed on a betting layout including a first betting area having a plurality of betting positions distinguished by unique numerical indicium and index indicium combinations corresponding to the primary wagering positions displayed thereon, and a second betting area having at least one supplemental indicium displayed thereon corresponding to the at least one supplemental wagering position;

spinning the roulette wheel, thereby randomly selecting a winning wagering position on the roulette wheel;

collecting the entire wager of each player placing a losing wager;

determining the exact odds of any winning wagers; and paying out winning wagers to any winning players in an amount based upon the exact odds.

2. The method of playing a roulette game according to claim 1, wherein said at least one of the background colors comprises two of the background colors.

3. The method of playing a roulette game according to claim 1, wherein said set of numerical indicia comprises a sequence of ten numbers, said primary wagering positions consisting of thirty primary wagering positions, each of the thirty primary wagering positions having a unique combination of one of the ten numerical indicia displayed on one of the three background colors.

4. The method of playing a roulette game according to claim 1, wherein said set of numerical indicia comprises a sequence of ten numbers, said primary wagering positions consisting of forty primary wagering positions, each of the numerical indicia being displayed in numerical order four times, each of the index indicia being displayed in a pattern of three three-color sequences followed by a position having all three colors displayed thereon, whereby the forty primary wagering positions comprise twenty mutually distinct combinations of numerical indicia and background colors, each of the twenty combinations being displayed twice on the wheel.

5. The method of playing a roulette game according to claim 1, wherein said betting layout further includes betting positions corresponding to any one of the background colors, regardless of the numerical indicium on the winning wagering position.

6. The method of playing a roulette game according to claim 1, wherein said betting layout further includes an even number wagering position and an odd number wagering position corresponding to whether the numerical indicium displayed on the winning wagering position is an even number or an odd number.

7. The method of playing roulette game according to claim 1, wherein said at least one supplemental wagering position comprises a plurality of supplemental wagering positions.

8. The method of playing roulette game according to claim 1, wherein said at least one supplemental wagering position has a plurality of index indicia thereon corresponding to all of the distinct index indicia in the set of index indicia.

9. The method of playing roulette game according to claim 1, further comprising the steps of:

retaining a percentage of the winning wagers of non-continuing winning single turn players as a house profit percentage; and encouraging progressive wagers by waiving the retention of a house profit percentage for winning players who elect to continue play by placing a progressive wager.

10. The method of playing roulette game according to claim 9, further comprising the step of restricting progressive wagers to said numerical indicia position designations on the wheel.

11. The method of playing a roulette game according to claim 1, wherein said set of numerical indicia comprises a sequence of numbers in numerical order.

12. The method of playing a roulette game according to claim 11, wherein said plurality of wagering positions includes repeated sequences of the numbers in numerical order.

13. The method of playing a roulette game according to claim 11, wherein said plurality of wagering positions includes repeated sequences of the set of numbers in random numerical order.

14. The method of playing a roulette game according to claim 1, wherein said step of providing a roulette wheel further comprises furnishing a display of a simulated roulette wheel on an electronic game machine, said step of spinning the roulette wheel comprising executing a random number algorithm on an electronic processor to simulate spinning the wheel.

15. The method of playing a roulette game according to claim 14, wherein said electronic game machine is connected to a computer network, the step of determining the exact odds of any winning wagers being performed electronically according to amount of game activity and popularity, any payout being determined according to the exact odds so determined.

* * * * *